United States Patent [19]

Shibuya et al.

[11] 4,412,734

[45] Nov. 1, 1983

[54] ELECTROPHOTOGRAPHIC COPIER WITH COPY PAPER SUPPLY DEVICE

[75] Inventors: Kunihiro Shibuya; Yasuhiro Iwata, both of Yokohama, Japan

[73] Assignee: Tokyo Shibaura Denki Kabushiki Kaisha, Kanagawa, Japan

[21] Appl. No.: 307,579

[22] Filed: Oct. 1, 1981

[30] Foreign Application Priority Data

Oct. 30, 1980 [JP] Japan ..... 55-153295[U]

[51] Int. Cl.[3] ..... G03G 15/00

[52] U.S. Cl. ..... 355/3 SH; 355/3 R; 355/14 SH; 271/225

[58] Field of Search ..... 355/3 R, 3 SH, 14 SH, 355/15, 3 FU, 16, 11; 271/171, 160, 225

[56] References Cited

U.S. PATENT DOCUMENTS 3,960,446 6/1976 Ogawa et al. ..... 355/3 R X
3,966,316 6/1976 Pfeifer et al. ..... 355/15 X
3,988,061 10/1976 Root ..... 355/3 F UX
3,997,262 12/1976 Doi et al. ..... 355/11
4,032,136 6/1977 Komaba et al. ..... 271/171
4,173,410 11/1979 Tabata et al. ..... 355/3 SH X
4,272,180 6/1981 Satomi et al. ..... 355/14 SH X

*Primary Examiner*—A. C. Prescott
*Attorney, Agent, or Firm*—Cushman, Darby & Cushman

[57] ABSTRACT

An electrophotographic copier includes a housing having a lower frame and an upper frame pivotally connected to the lower frame. A lower paper supplying device and an upper paper supplying device are provided on the housing. The lower and upper paper supplying devices include first and second paper guide plates, respectively. A third paper guide plate is pivotally mounted on the first side of the lower frame and it defines a first paper feed guide path of the lower paper supplying device with the first paper guide plate and a second paper feed guide path of the upper paper supplying device with the second paper guide plate.

10 Claims, 4 Drawing Figures

ELECTROPHOTOGRAPHIC COPIER WITH COPY PAPER SUPPLY DEVICE

BACKGROUND OF THE INVENTION

The present invention relates to electrophotographic copiers having paper supplying devices, and more particularly to those electrophotographic copiers provided with a housing comprised of a lower frame and an upper frame.

The housing of a conventional electrophotographic copier (see e.g., U.S. Pat. No. 3,997,262) is divided into two portions. Namely, an upper frame including the photoconductive drum, and a lower frame including devices for copy paper feeding, transfer and fixing etc. The upper frame is pivotally connected to the lower frame for raising the former about the pivotal connection to enable access to the mechanisms of the copying apparatus. Thus, replacing and maintenance of the photoconductive drum or other machine parts may be effected very efficiently. Especially, jammed copy paper may be readily removed when the jamming occurs.

Another conventional electrophotographic copier (see e.g., U.S. Pat. No. 3,985,436) has disposed in the lower frame both a lower paper supply device, for automatically supplying copy paper from a copy paper cassette to a traveling path, and an upper paper supply device, for manually supplying copy paper from a manual feed guide to the traveling path. In such above-mentioned copiers, copy paper supplied through the manual feed guide is guided by an upper paper guide path until it reaches the paper traveling path. Copy paper supplied from the cassette is guided by a lower paper guide path until it reaches the paper traveling path. The upper paper guide path is defined by an upper paper guide plate and an intermediate paper guide plate spaced from the upper paper guide plate. The lower paper guide path is defined by a lower paper guide plate and the above mentioned intermediate paper guide plate spaced from the lower paper guide plate.

However, quite frequently, paper jams at the intersection of the upper and lower paper guide paths. Furthermore, paper continues to be automatically supplied from the cassette of the copy paper supply device after jamming occurs at the intersection. Even if the upper frame of the housing is raised from the lower frame, the jammed paper in the paper guide path cannot be removed, since the space between the plates of the lower and upper paper guide paths is small. Therefore, the cassette must be removed from the housing and the operator must put his hand into the cassette port to reach the jammed paper and remove it.

SUMMARY OF THE INVENTION

It is an object of the present invention to provide an electrophotographic copier from which jammed copy paper in the copy paper supply device can readily be removed.

The present invention is directed to an electrophotographic copier having a housing including a lower frame and an upper frame pivotally connected to the lower frame. A lower copy paper supply device is provided on the housing and includes a lower paper guide plate. An upper copy paper supply device is provided on the housing and includes an upper paper guide plate. An intermediate paper guide plate is provided between the upper and lower paper guide plates for defining a lower paper guide path between the lower plate and the intermediate plate and an upper paper guide path between the intermediate plate and the upper plate. The intermediate paper guide plate is pivotally mounted on the housing (either upper or lower frame). Therefore, the lower and upper paper guide paths can be opened when the upper frame is raised from the lower frame. When copy paper jamming occurs in the lower or upper paper guide path, the jammed paper can be readily removed.

DETAILED DESCRIPTION OF THE PREFERRED EMBODIMENT

Figure 1:
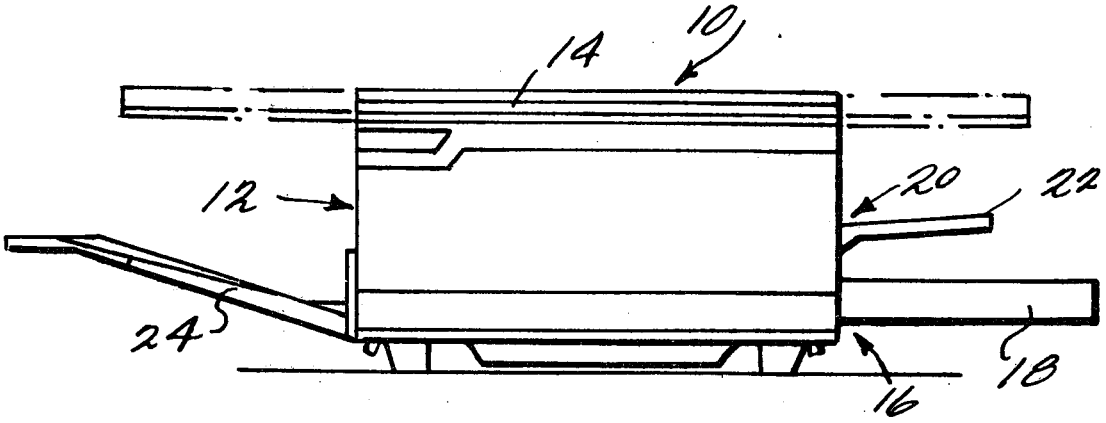
FIG. 1 is a front view showing an embodiment of the present invention.
Figure 2:
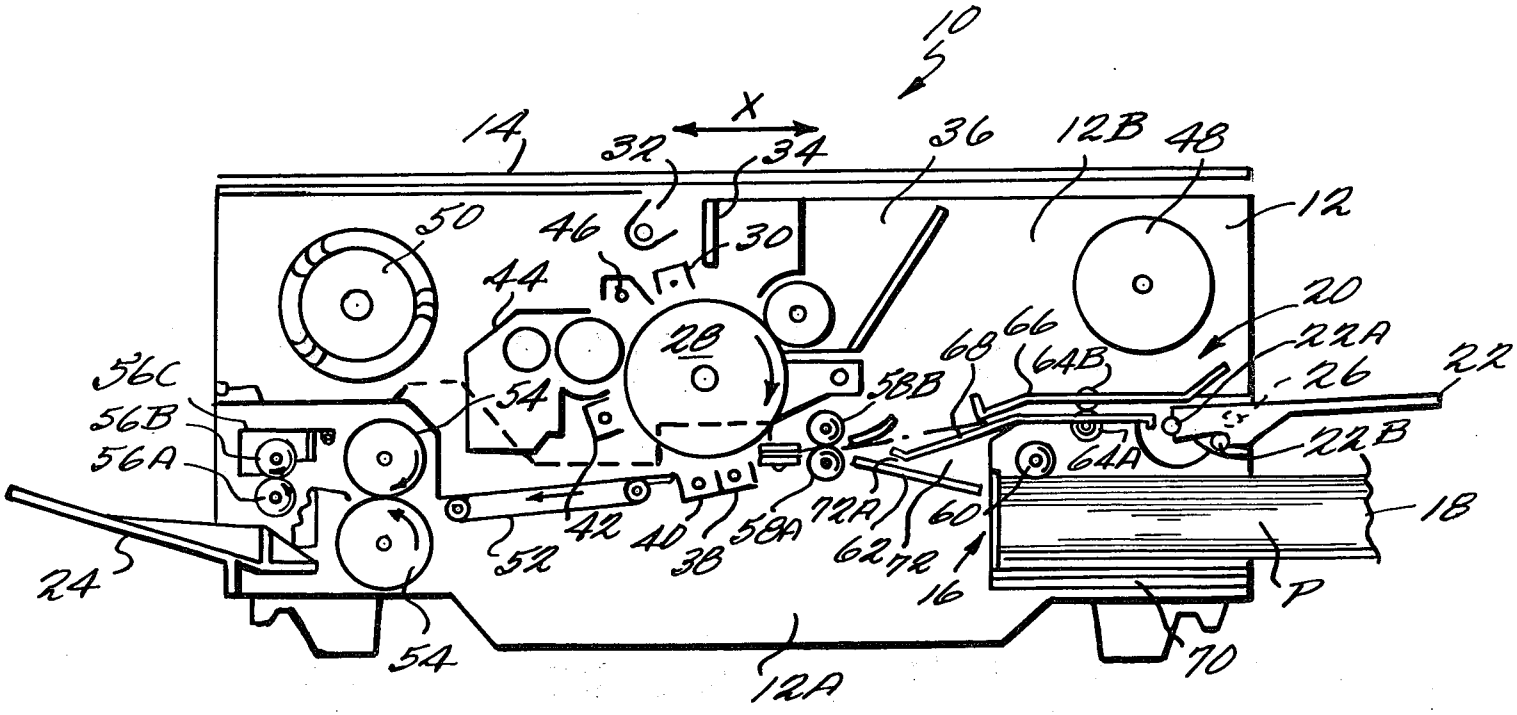
FIG. 2 is a sectional schematic view of FIG. 1.
Figure 3:
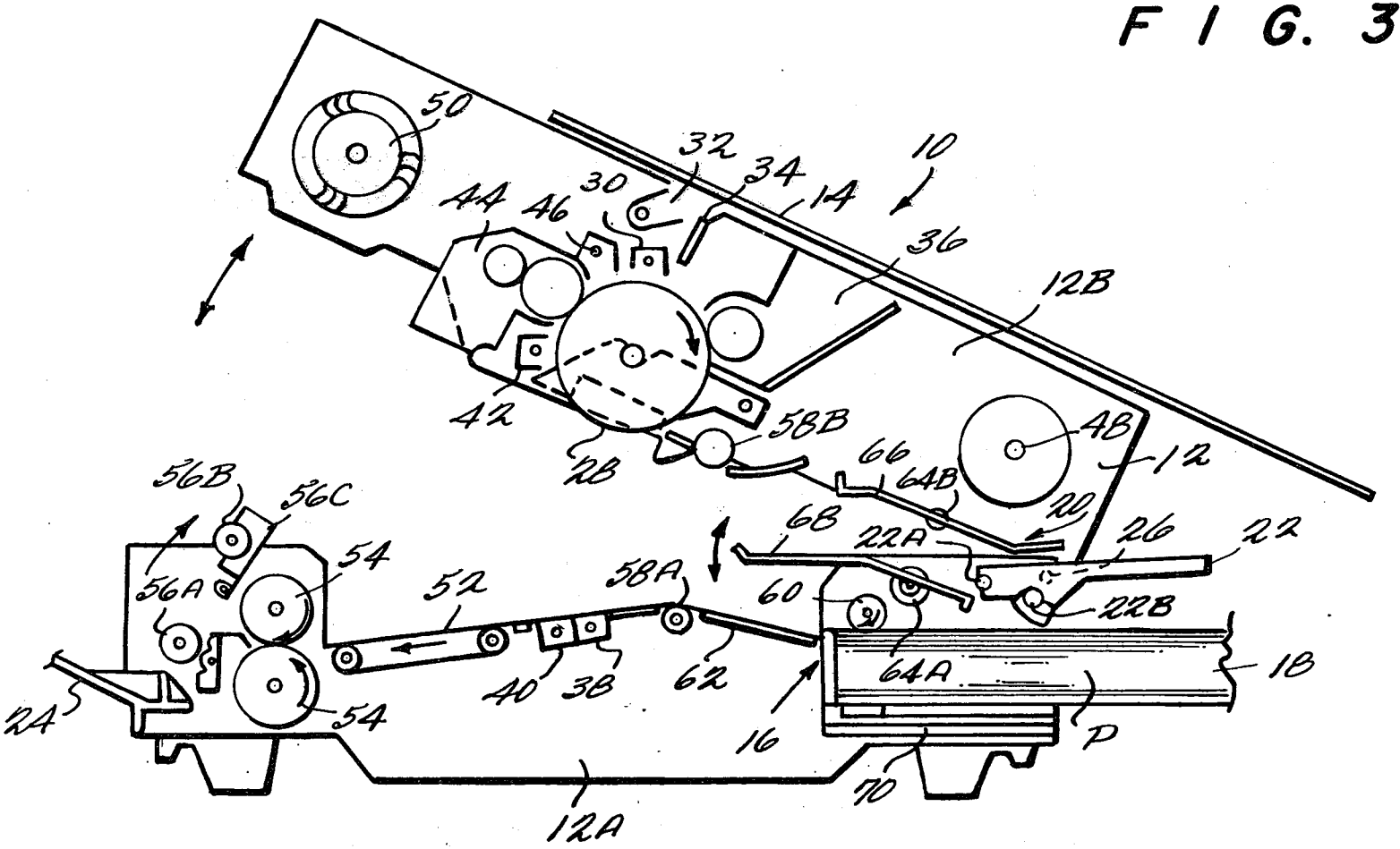
FIG. 3 is a sectional schematic view showing the construction of the housing with an upper frame in its raised position.

Referring now to FIGS. 1–4, an explanation will be given regarding a preferred embodiment of the invention. As shown in FIG. 1, an electrophotographic copier 10 includes a housing 12, an original holder 14, a lower copy paper supply device 16 such as a copy paper cassette 18, an upper paper supply device 20 such as a manual feed guide 22 and a receptacle 24. As shown in FIGS. 2 and 3, housing 12, having a first or right side and a second or left side, consists of a lower frame 12A and an upper frame 12B. Upper frame 12B is pivotally connected on the right side of lower frame 12A through a pivot 26 so that it may swing upward to provide access to lower frame 12A. Original holder 14 is provided on the top of upper frame 12B on which an original is laid. Original holder 14 can move back and forth as indicated by the arrow X.

On upper frame 12B, photoconductive drum 28, a lamp 32, a light guide array 34, a corona charger 30, a developing device 36, a corona charger 42, a cleaning device 44, a lamp 46, a motor 48, a fan 50, a feed roller 64B, an upper paper guide plate 66 and a roller 58B are provided.

Photoconductive drum 28 is located substantially in the middle of upper frame 12B and is linked to an appropriate drive means (not shown) to rotate in the direction indicated by the arrow in FIG. 2. Corona charger 30 is mounted adjacent drum 28 for applying a uniform electrostatic charge to photoconductive drum 28. Lamp 32 and light guide array 34 are disposed between original holder 14 and drum 28 for projecting the optical image of the original laid on holder 14 to drum 28 so that the electrostatic latent image will be formed on drum 28. Developing device 36 is provided adjacent drum 28 for developing the electrostatic latent image to the visible image. Corona charger 42 is mounted on the left side of drum 28 for removing the residual charge on drum 28 by applying a corona charge of opposite polarity to the polarity of the electrostatic latent image. Cleaning device 44 is provided adjacent drum 28 for removing the residual toner. Lamp 46 is located between cleaning device 44 and corona charger 30 for removing the residual charge by projecting a light uniformly to drum 28. Motor 48 is provided on the right side of upper frame 12B for rotating drum 28, sheet traveling rollers, etc. A fan 50 is provided on the left side of upper frame 12B for exhausting air from inside housing 12 to prevent the temperature from increasing therein.

On lower frame 12A, manual feed guide 22, a feed roller 64A, an intermediate paper guide plate 68, a roller 58A, copy paper cassette 18, a feed roller 60, a lower paper guide plate 62, corona chargers 38, 40, a conveyor 52, fixing rollers 54, exit rollers 56A, 56B and receptacle 24 are provided.

Substantially in the middle of lower frame 12A and facing drum 28, corona charger 38 is mounted for transferring the visible image to a copy paper P conveyed from lower paper supply device 16. Corona charger 40 is integral with corona charger 38 in parallel for separating copy paper P from drum 28. Conveyor 52 is disposed adjacent corona charger 40 for conveying copy paper P from drum 28 to fixing rollers 54. Fixing rollers 54 are rotatably provided adjacent conveyor 52 for fixing the transferred visible image onto copy paper P. Exit rollers 56A, 56B are located the left side of lower frame 12A for discharging the fixed visible image onto paper P. Exit roller 56B is rotatably provided on a support plate 56C. As shown in FIG. 3, support plate 56C is pivotally mounted on lower frame 12A. Upon raising support plate 56C with exit roller 56B, as indicated by the arrow, jammed paper may be readily removed from the area around exit rollers 57A, 57B and fixing rollers 54. Receptacle 24 is provided on the left side of lower frame 12A for receiving discharged copy paper P.

Lower copy paper supply device 16 comprises copy paper cassette 18, feed roller 60 and lower paper guide plate 62. Copy paper cassette 18 is inserted into housing 12 by sliding it along guide rails 70 which guide cassette 18 into operable relationship with feed roller 60. Feed roller 60, disposed above cassette 18, contacts the uppermost paper of copy paper P and its rotation feeds out the uppermost sheet from cassette 18. Lower paper guide plate 62 is mounted on lower frame 12A and is disposed between cassette 18 and roller 58A.

Figure 4:
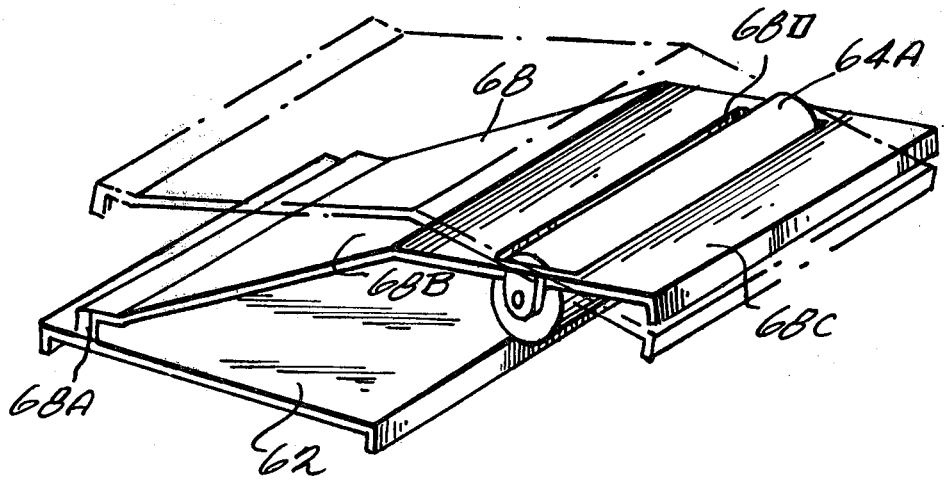
FIG. 4 is a perspective view showing the paper guide plate of the copy paper supply device.

Intermediate paper guide plate 68 comprises a slanting surface 68B and a horizontal surface 68C and is pivotally mounted on lower frame 12A as shown in FIG. 4. Intermediate paper guide plate 68 has an opening 68D along the width of the horizontal surface portion. Plate 68 defines a lower paper guide path 72 with lower paper guide plate 62 for guiding copy paper P fed out from cassette 18 to rollers 58A, 58B. Two spaced downwardly oriented tabs 68A are formed at the end of intermediate paper guide plate 68 and ordinary contact lower paper guide plate 62 such as to form a gap 72A (see FIG. 2) defined between the end of intermediate guide plate 68 and lower guide plate 62. Gap 72A allows the passage of copy paper P.

Upper paper supply device 20 comprises manual feed guide 22, upper paper guide plate 66 and feed rollers 64A, 64B. Manual paper feed guide 22 is detachably supported at pins 22A, 22B secured on lower frame 12A. Feed roller 64A is rotatably disposed on lower frame 12A and a part thereof projects through opening 68D of intermediate paper guide plate 68. Feed roller 64A is linked to an appropriate drive means (not shown) to rotate. Feed roller 64B is rotatably provided at upper frame 12B and rotated according to rotation of feed roller 64A. Feed rollers 64A, 64B draw papers manually inserted through manual paper feed guide 22. Upper paper guide plate 66 defines an upper paper guide path 74 with intermediate paper guide plate 68 for guiding paper conveying from manual feed guide 22 to rollers 58A, 58B.

When the copying operation is started after setting an original on the holder 14, photoconductive drum 28 starts to rotate. The surface of drum 28 passes by lamp 46 which eliminates the residual charge of drum 28. The surface of drum 28 then is uniformly precharged by corona charger 30. Next, holder 14 moves over the middle portion of housing 12 from left side to right side with lamp 32 in the "on" state. As a result, a slight exposure of the surface of drum 28 to the optical image of the original occurs through light guide array 34 to form an electrostatic latent image on the surface of drum 28. Subsequently, the electrostatic latent image is developed to a visible image as drum 28 passes by developing device 36.

Meanwhile, in synchronism with the formation of an image on the surface of drum 28, copy paper P is taken from cassette 18 and fed into the transfer section along lower paper guide path 72 and rollers 58A, 58B. The visible image formed on drum 28 is transferred onto copy paper P by the action of corona charger 38. Copy paper P is then separated from drum 28 by corona charger 40 and conveyed by conveyor 52 to fixing rollers 54 where the transferred image is fixed on copy paper P. Finally, copy paper P is discharged through exit rollers 56A, 56B to receptacle 24.

As the surface of drum 28 passes by corona charger 42 and cleaning device 44, the residual charge and toner on drum 28 are removed. Drum 28 then again faces lamp 46 and the process is repeated.

When the size of copy paper in the cassette 18 is different from the size desired, upper paper supply device 20 will be used. A copy paper is manually inserted into housing 12 through manual feed guide 22 until it hits a contact portion between feed rollers 64A and 64B. And when copying operation is started, the copy paper is taken in by rotation of feed rollers 64A, 64B and fed into the transfer section along upper paper guide path 74 and rollers 58A, 58B. Then the copying operation is continued as described above.

When copy paper jams in the passageway between rollers 58A, 58B and fixing rollers 54 or in the upper paper guide path 74, the operator raises the left end of upper frame 12B so that it is supported in an open inclined position as shown in FIG. 3 by a support mechanism (not shown). Copy paper jammed in the passageway between rollers 58A, 58B and fixing rollers 54 or in the upper paper guide path 74 will appear when upper frame 12B is raised, and may then be readily removed therefrom. When a jam occurs in the lower sheet guide path 72, after raising upper frame 12B the operator raises the left end of intermediate paper guide 68 so that it is supported in an opened position as shown in FIG. 3 by an operator's hand. The jammed paper in the opened lower paper guide path 72 may then be removed.

Those skilled in the art will readily appreciate that many changes can be made to the embodiment described above within the scope of this invention. For example, intermediate paper guide plate 68 may be pivotably connected to upper frame 12B instead of lower frame 12A.

Accordingly, all such alternative embodiments are intended to be included within the scope of this invention as defined by the following claims.

What is claimed is:

1. An electrophotographic copier comprising:

a housing including a first frame and a second frame pivotally connected on the housing;

a first paper supplying means for supplying copy paper within said housing and having a first paper guide plate mounted on said first frame;

a second paper supplying means for supplying copy paper within said housing and having a second paper guide plate mounted on said second frame;

a third paper guide plate pivotally mounted on the housing, said third paper guide plate defining a first paper feed guide path with said first paper guide plate and a second paper feed guide path with said second paper guide plate;

said first paper supplying means including said first paper feed guide path and said second paper supplying means including said second paper feed guide path; and means for receiving paper from either of said first and second paper supplying means and producing an image of an original thereon.

2. The electrophotographic copier of claim 1 wherein said first paper supplying means includes a cassette containing copy paper.

3. The electrophotographic copier of claim 1 wherein said second paper supplying means includes a manual feed guide for accepting a copy paper manually inserted into the housing.

4. The electrophotographic copier of claim 1 wherein said receiving and producing means comprises a photoconductive drum, an exposure means for transmitting an optical image of an original to said photoconductive drum and a developing means for converting the optical image to a visible image on said photoconductive drum, said drum, exposure means and developing means all being disposed on said second frame.

5. The electrophotographic copier of claim 4 wherein said receiving and producing means further comprises a corona charging means for transferring the visible image formed on the photoconductive drum to a copy paper selectively supplied from one of said first and second paper supplying means, conveying means for conveying the copy paper with the transferred image and a fixing means for fixing the transferred image on the copy paper conveyed by the conveyor, said charging means, conveying means and fixing means all being disposed on said first frame.

6. The electrophotographic copier of claim 5 wherein said receiving and producing means further comprises a pair of exit rollers for discharging the copy paper with the transferred, fixed image thereon, said exit rollers being disposed on said first frame and one of said exit rollers being movable between a contact position with the other of said exit rollers and a separated position, out of contact with said other exit roller.

7. The electrophotographic copier of claim 5 wherein said receiving and producing means further comprises receptacle means disposed on the second side of the first frame for receiving the image fixed copy paper.

8. The electrophotographic copier of claim 1 wherein said third paper guide is mounted adjacent the opening between said first and second frames.

9. The electrophotographic copier of claim 8 wherein said third paper guide plate is mounted on an upper portion of the lower of said first and second frames.

10. The electrophotographic copier of claim 1 wherein said third paper guide plate is mounted for pivoting to enable clearing of paper jams only when said first and second frames are pivotably separated.

* * * * *